US005509601A

United States Patent [19]

Drabick

[11] Patent Number: 5,509,601

[45] Date of Patent: Apr. 23, 1996

[54] INTERNAL PACKAGE SPACER/PROTECTOR

[76] Inventor: Ronald Drabick, 8680 Briggle Ave., East Sparta, Ohio 44626

[21] Appl. No.: 520,073

[22] Filed: Aug. 28, 1995

[51] Int. Cl.[6] ..... B65D 5/50

[52] U.S. Cl. ..... 229/199; 229/906; 426/115; 426/124

[58] Field of Search ..... 229/199, 902, 229/906; 426/110, 115, 124, 128

[56] References Cited

U.S. PATENT DOCUMENTS

| | | | |
|---|---|---|---|
| 1,944,305 | 1/1934 | Schmidt | 229/199 |
| 2,713,982 | 7/1955 | Camp et al. | 229/199 |
| 4,417,660 | 11/1983 | Mason | 229/199 |
| 4,498,586 | 2/1985 | Vitale | 426/124 |
| 4,700,843 | 10/1987 | Cohen | 229/906 |
| 4,877,609 | 10/1989 | Beck et al. | 229/906 |
| 5,077,050 | 12/1991 | Wall | 426/124 |
| 5,082,677 | 1/1992 | Bear | 426/124 |
| 5,366,144 | 11/1994 | Eisman | 229/199 |

*Primary Examiner*—Gary E. Elkins
*Attorney, Agent, or Firm*—E. J. Holler

[57] ABSTRACT

This invention relates to an internal package spacer/protector device for frangible soft foodstuffs. The device is readily molded of thermoplastic material and especially suitable for insertion into the subject packages to support the cover portins of large flexible cartons used to package pizza, pies, cakes and similar foodstuffs. The device prevents damage to such foodstuffs when contacted by the box covers.

10 Claims, 2 Drawing Sheets

INTERNAL PACKAGE SPACER/PROTECTOR

BACKGROUND OF THE INVENTION

The present invention relates to an internal package spacer/protector device for improving the packaging of frangible soft foodstuffs. Such foodstuffs tend to be damaged when packaged in boxes or cartons having large covers which tend to sag, especially when top loaded. Such boxes or cartons are commonly those fabricated of most economical paper fiberboard or cardboard such as widely used to package pizza pies or cakes for temporary storage, sale or delivery while hot or freshly baked. Such boxes or cartons are intended for one-time use.

This invention in particular relates to a package spacer and protector device which is readily molded from thermoplastic material to possess minimal size, weight and cost, and which is especially suitable for insertion into the subject packages to support the cover portions of large flexible cartons used to package pizza pies, cakes and similar foodstuffs. Such foods are easily damaged during storage, transport, sale and/or delivery. Pizza pies are readily susceptible to damage due to their unique toppings of melted cheese combined with other varied edible ingredients when the heat-softened baked articles are directly contacted by the box covers.

As stated, the boxes which are normally manufactured from paper chipboard or fiberboard are usually large in size and shallow in depth to contain the food product. Their cover portions exhibit a tendency to sag in the center area or be readily depressed thereat when loaded from above. Thus, the contained pizza pies or cakes may be easily damaged causing the cover portion to stick to or damage the food product, especially when the shallow loaded boxes are stacked on one another for temporary storage, sale or delivery.

Prior art package savers are not designed for rapid dispensing in busy fast-food operations, but are manufactured and sold in a randomly-packaged manner which results in such savers being fumbled, dropped, and not easily separated due to their three-legged non-uniform configuration. Such savers are disclosed in U.S. Pat. No. 4,498,586 to Vitale where their inherent deficiencies are readily apparent. Further, such savers cannot be pre-mounted in the boxes for use of the boxes as needed or required for filling multiple orders.

Accordingly, it is a primary objective of the present invention to provide an inexpensive uniformly-shaped spacer and food protector device which can be very economically manufactured and sold in a multiple-unit dispenser for use with thin-walled shallow boxes having broad cover portions. The spacers can be quickly and positively grasped for proper mounting in the food product as packaged, or be pre-mounted in the individual boxes for their rapid loading as needed.

Another objective of the present invention is to provide an improved package spacer for protecting food products such as newly-baked pizza pies, cakes or other products from damage during storage, sale or delivery.

Another objective of the present invention is to provide an inexpensive squarely-shaped multi-legged spacer device for large boxes for protecting foodstuffs such as newly-baked pizza pies or decorated cakes when packaged, such devices being configured for rapid dispensing and individual use as desired for easy handling and placement in proper location, or pre-loading the boxes with the device prior to packing the boxes.

With the aforesaid and additional objectives in mind, the invention comprises an improved package spacer and protector, and the combination of a multiple-unit dispenser member therefor, which spacers are stackable and are readily usable from a multiple stack in an expedient and unique manner.

BRIEF DESCRIPTION OF THE DRAWINGS

In the accompanying drawings, the same reference numerals indicate the same parts and elements of the spacer and dispenser therefor in all views.

DESCRIPTION OF THE PREFERRED EMBODIMENT

The subject spacer as disclosed hereinabove is preferably molded by injection molding as a unitary multilegged device having a broad flat top portion. It may be economically molded from heat-resistant thermosetting plastic resin such as high-density polyethylene which will readily withstand temperatures as high as 450° F. in use. This feature is particularly important in packaging hot foods.

Figure 1:
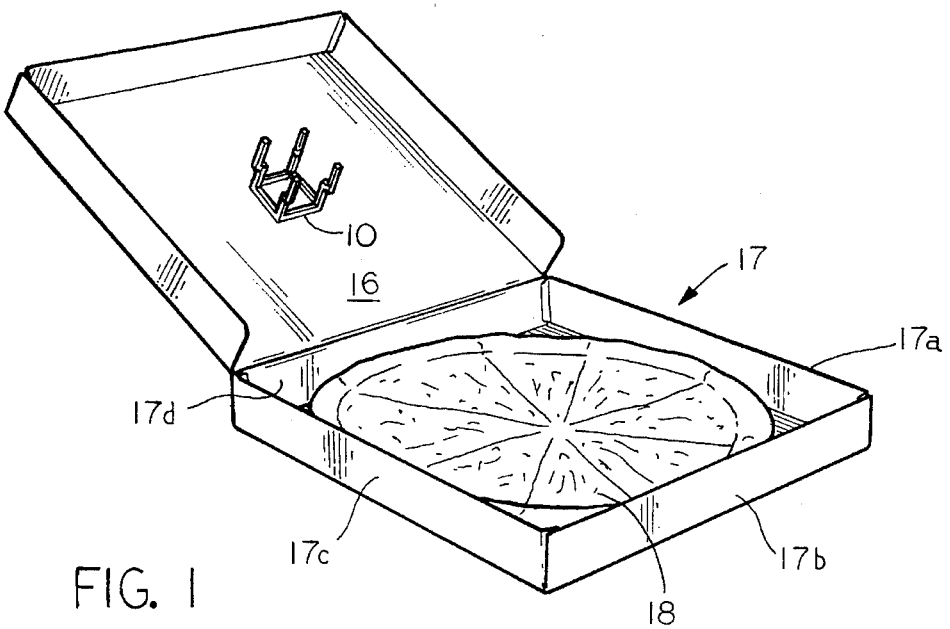
FIG. 1 is a perspective view of the subject package spacer/protector device and carton for packaged pizza pie with the carton in opened arrangement.
Figure 2:
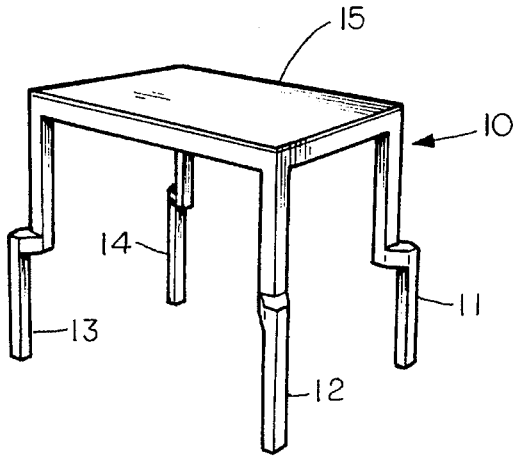
FIG. 2 is an enlarged perspective view of an individual spacer/protector device alone as used in the carton shown in FIG. 1.

A preferred embodiment of this invention is shown in FIGS. 1 and 2 wherein the spacer/protector device 10 has a square shape in plan with four equal-length legs 11, 12, 13 and 14. The top portion 15 is generally flat or planar for contact with or attachment to the underside of the box cover 16. The box 17 is typically rectangular in shape having four upright sides 17*a*, 17*b*, 17*c* and 17*d*. The pizza product 18 is normally placed in the box 17 in a central area in flat planar arrangement.

The spacer 10 as shown in enlarged detail in FIG. 2 has four equal length legs 11 to 14 which are stepped outwardly at an intermediate area of vertical dimensions over their overall length. The stepped or offset configuration of the legs permit their being stacked in vertical array for insertion into a tubular dispenser 20. The individual similar legs have relatively small and thin cross-section to minimize disturbance or marking of the product when packaged in the box. The flat upper surface 15 of the spacer is sufficiently broad to widen the effect of top loading of the cover 16 or alternately attachment of the spacer to the cover underside as desired.

Figure 3:
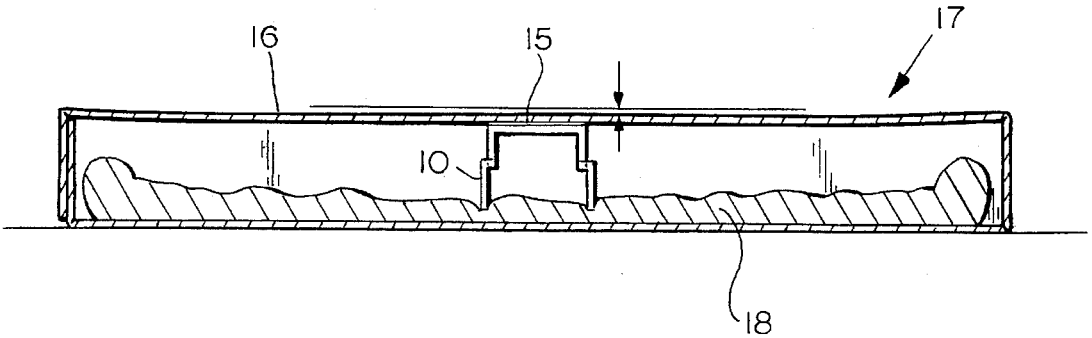
FIG. 3 is an enlarged cross-sectional view of the spacer/protector, carton and pizza pie as shown in FIG. 1 with the carton shown in closed arrangement.

FIG. 3 shows in cross-section the spacer 10 being contacted by the box cover 16 for support thereof, the plural legs of the spacer penetrating the food product to a greater or lesser degree. The legs are relatively thin and essentially straight except for their intermediate stepped or offset areas, the lower portions having greater lateral spacing at the corners. The preferably square cross-section of the spacer and the stepped legs permit easier grasping and manual mounting of the spacer in the box interior with the product in the box. The contour of the spacers facilitates their being organized into a single orderly column of lesser height. The broad upper surface of the spacer permits broader and greater loading of the box cover without undue sagging of the cover, keeping the cover out of contact with the packaged product. The spacer is disposable with the box since it is intended for one-time use.

Figure 4:
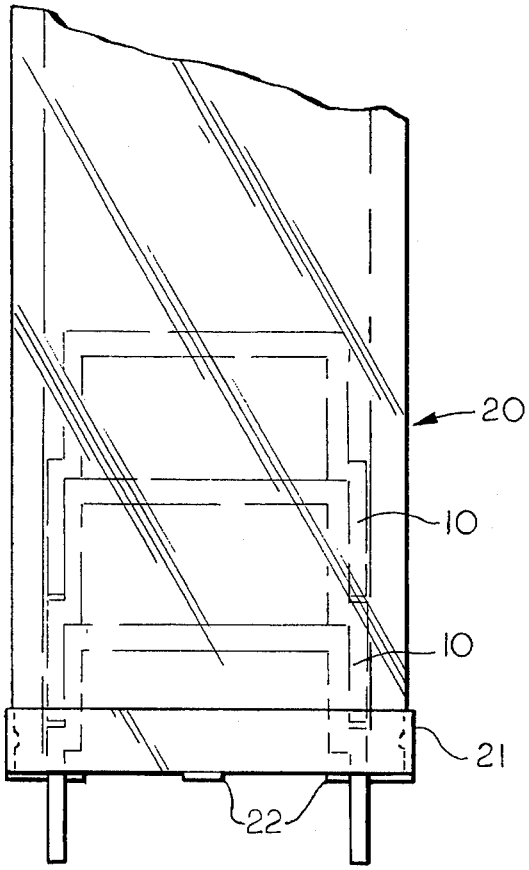
FIG. 4 is an enlarged fragmentary side elevational view of a hollow tubular dispenser member containing a plural stack of spacer devices for easy and rapid dispensing.

FIG. 4 shows a stacked array of a plural number of the square spacers contained within a hollow tubular dispenser 20 having a complemental cross-section to the spacer shape. The reduced dimensions of the spacer at the upper leg portions permit stacking of the spacers to save vertical height of the stack and increased capacity of the dispenser. The dispenser is preferably comprised of acrylic resin having great transparency to indicate the number of spacers in the dispenser during its use in fast food operations, for example. The dispenser may be mounted or hung vertically for gravity-fed use near the food packaging operation for ready use of the individual spacers. The gravity-fed dispensing system eliminates the handling confusion and waste caused by the use of round loosely-boxed spacers. The dispenser increases the efficiency of time and space of dispensing the individual spacers in an orderly manner one at a time.

Figure 5:
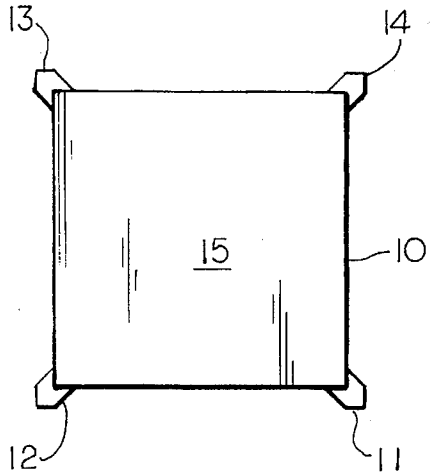
FIG. 5 is a top plan view of a stacked array of the plural spacer devices shown in the dispenser in FIG. 4.
Figure 6:
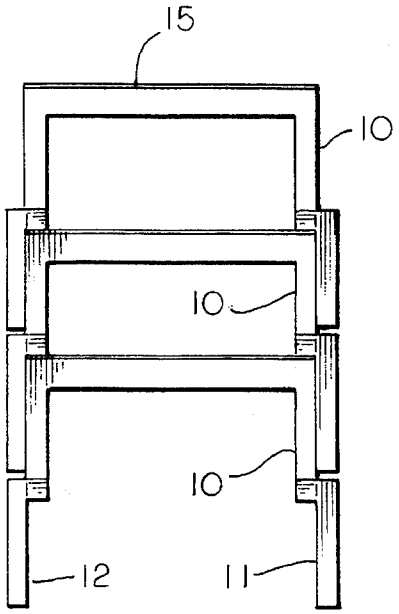
FIG. 6 is a side elevational view of the stacked spacer devices shown in the dispenser member in FIGS. 4 and 5.
Figure 7:
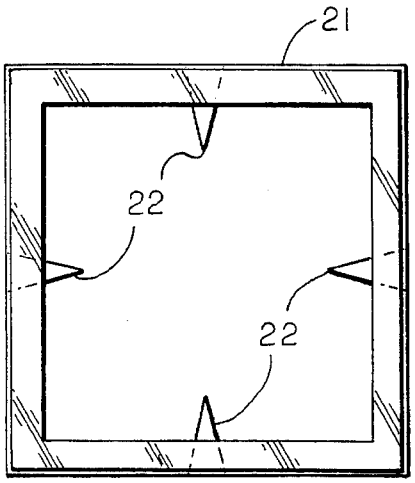
FIG. 7 is an enlarged view of the bottom cap member alone shown at the bottom of the dispenser member shown in FIG. 4.

FIG. 5 is a top plan view of the stacked square spacers 10 while FIG. 6 is a side elevational view of the stack removed from the dispenser. The dispenser 20 has a square snap-on collar 21 at its base having a complemental shape to the spacers fitted around the bottom portion of the dispenser. The collar 21 has a series of four inwardly-extending fingers 22 located at intermediate areas of its sides to engage the lowermost spacer to permit removal of a single spacer in one-at-a-time serial progression.

The foregoing embodiment of the present invention envisions the broad upper surface of the square spacer/protector being smooth and unadorned for surface- to-surface physical contact with and broadly supporting the box cover.

In another embodiment of the invention, such surface of the spacer/protector 10 has an added adhesive layer (not shown) applied thereto on its upper flat surface such as a self-sticking starch-containing adhesive material which is non-toxic and food-safe. Such adhesion of the spacer to the cover underside is shown in FIG. 1. The adhesive material may have a peel-strip of non-stick plastic material thereover for ready dispensing of the spacers singly, and then removing the peel-strip to adhere the spacer to the cover underside. A single spacer is thereby mounted on the inner surface of the box cover of an empty box, or series of empty boxes, each ready to receive a newly-baked pie or cake. Thus, the spacer is prepositioned in the box center region for top support of the cover.

The square four-legged tubular dispenser is by its geometry self-aligning. The offset legs of the spacer are employed to increase the capacity of the tube dispenser, thus saving time and decreasing the number of reloadings of the dispenser. The peel-and-stick adhesive on the top surface of the spacer serves two purposes. First, it enables the spacer to be put in place either at the time of box assembly or at the time that the pizza or other food product is boxed. Secondly, as it is glued to the underside of the cover, the spacer is then disposed of as a part of the box, preventing littering.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention are by way of example, and the scope of the invention is not limited to the exact details shown or described.

Various modifications may b resorted to within the spirit and scope of the appended claims.

I claim:

1. The combination of a package having a flexible cover, a food article contained within said package and spaced downwardly from said flexible cover, and a unitary molded plastic spacer/protector device for positioning between said flexible cover and said food article for supporting said cover and protecting said food article from damage by downward pressure on said cover, said spacer device comprising an upper body portion having an essentially planar upper surface and at least four leg portions extending downwardly therefrom for engaging the packaged article and with its planar upper surface adapted to contact the package cover to increase its load-carrying capacity without damaging the packaged food article.

2. The combination in accordance with claim 1, wherein the said leg portions of said spacer/protector device have a thin stepped configuration for stacked packaging and individual dispensing thereof.

3. The combination in accordance with claim 1, wherein the said spacer/protector device has a square configuration in plan with the said four leg portions located at its corners and extending downwardly therefrom.

4. The combination in accordance with claim 1, wherein the said spacer/protector device is formed of heat-resistant thermoplastic material.

5. The combination in accordance with claim 1, including an adhered layer of food-safe non-toxic adhesive material located on said planar upper surface of said spacer/protector device for attachment of said device to the inner surface of said cover.

6. The combination in accordance with claim 5, wherein said adhesive material comprises primarily a starch-containing material.

7. The combination in accordance with claim 1, wherein said spacer/protector device is formed of high-density polyethylene material.

8. The combination in accordance with claim 1, including a hollow tubular dispenser member having a square cross-sectional configuration to retain a plurality of said spacer/protector devices therewithin in stacked relation for serially dispensing said devices individually for insertion into said package.

9. The combination in accordance with claim 8, wherein said hollow tubular dispenser member is comprised of rigid transparent plastic material.

10. The combination in accordance with claim 8, including a hollow bottom closure member for said dispenser member having a restricted lesser opening than the body portion of said dispenser member adapted to dispense said devices serially and individually for insertion into said packages.

* * * * *